US010690139B2

(12) United States Patent
Behnke et al.

(10) Patent No.: US 10,690,139 B2
(45) Date of Patent: Jun. 23, 2020

(54) MULTI-STAGE PUMP WITH ENHANCED THRUST BALANCING FEATURES

(71) Applicant: ITT MANUFACTURING ENTERPRISES LLC, Wilmington, DE (US)

(72) Inventors: Paul Walter Behnke, Seal Beach, CA (US); Timothy Michael Dach, Alhambra, CA (US); Carlos Preciado, San Bernardino, CA (US)

(73) Assignee: ITT MANUFACTURING ENTERPRISES LLC, Wilmington, DE (US)

( * ) Notice: Subject to any disclaimer, the term of this patent is extended or adjusted under 35 U.S.C. 154(b) by 0 days.

(21) Appl. No.: 15/973,883

(22) Filed: May 8, 2018

(65) Prior Publication Data

US 2019/0219068 A1 Jul. 18, 2019

Related U.S. Application Data

(60) Provisional application No. 62/504,166, filed on May 10, 2017.

(51) Int. Cl.
*F04D 29/42* (2006.01)
*F04D 29/041* (2006.01)
(Continued)

(52) U.S. Cl.
CPC ..... *F04D 29/041* (2013.01); *F04D 1/06* (2013.01); *F04D 3/00* (2013.01); *F04D 17/122* (2013.01);
(Continued)

(58) Field of Classification Search
CPC ..... F04D 1/06; F04D 17/122; F04D 29/041; F04D 29/426; F04D 29/2266; F05D 2260/606
See application file for complete search history.

(56) References Cited

U.S. PATENT DOCUMENTS 976,400 A * 11/1910 Salzer ..... F04D 29/2266 415/106
1,151,964 A * 8/1915 Peterson ..... F04D 29/2266 415/106
(Continued)

FOREIGN PATENT DOCUMENTS

CN 2766067 Y 3/2006
DE 2447758 A1 4/1976
(Continued)

OTHER PUBLICATIONS

English language Abstract of CN2766067Y.
English language Abstract of DE102009013156A1.
English language Abstract of DE2447758.

*Primary Examiner* — Ninh H. Nguyen
(74) *Attorney, Agent, or Firm* — Moritt Hock & Hamroff LLP; Bret P. Shapiro

(57) ABSTRACT

A multi-stage pump featuring first and second stages, each stage having an impeller arranged on a rotor of the pump, each impeller having a hub-side and an eye-side, and each impeller configured to pump a liquid through the pump that applies an axial thrust load caused by a pressure difference in an axial direction from the hub-side to the eye-side of each impeller; and a first and second stage pump casing, each casing configured to form a casing enclosure to contain components of the first stage and the second stage, including each impeller, and configured with one or more pump casing openings formed therein and passing thru the pump casing to leak at least some liquid being pumped from inside to outside the casing enclosure to reduce substantially the axial thrust load caused by the pressure difference in the axial direction from the hub-side to the eye-side of each impeller.

14 Claims, 8 Drawing Sheets

(51) Int. Cl.

| | |
|---|---|
| ***F04D 1/06*** | (2006.01) |
| ***F04D 17/12*** | (2006.01) |
| ***F04D 29/22*** | (2006.01) |
| ***F04D 27/02*** | (2006.01) |
| ***F04D 29/24*** | (2006.01) |
| ***F04D 3/00*** | (2006.01) |
| ***F04D 29/66*** | (2006.01) |

(52) U.S. Cl.
CPC ..... *F04D 27/023* (2013.01); *F04D 29/2266* (2013.01); *F04D 29/242* (2013.01); *F04D 29/426* (2013.01); *F04D 29/669* (2013.01); *F05D 2260/606* (2013.01)

(56) References Cited

U.S. PATENT DOCUMENTS

| | | | | |
|---|---|---|---|---|
| 2,680,410 | A * | 6/1954 | Kolb | F04D 29/106 415/104 |
| 3,364,866 | A * | 1/1968 | Sato | F04D 13/0666 417/365 |
| 4,170,435 | A * | 10/1979 | Swearingen | F01D 3/04 415/1 |
| 5,340,272 | A * | 8/1994 | Fehlau | F04D 1/06 277/408 |
| 8,226,352 | B2 | 1/2012 | Gutierrez et al. | |
| 9,377,027 | B2 | 6/2016 | Behnke et al. | |
| 2015/0211550 | A1 | 7/2015 | Behnke | |
| 2016/0102668 | A1 | 4/2016 | Tivarovsky | |

FOREIGN PATENT DOCUMENTS

| | | | |
|---|---|---|---|
| DE | 102009013156 | A1 | 9/2010 |
| GB | 956731 | A | 4/1964 |

* cited by examiner

| BM ITEM | DESCRIPTION |
|---|---|
| 1 | PUMP SHAFT |
| 2 | BOWL INTERMEDIATE |
| 3 | BOWL ADAPTER |
| 4 | BEARING BOWL |
| 5 | IMPELLER |
| 6 | WEAR RING BWL SUCT SIDE |
| 7 | WEAR RING BWL BAL SIDE |
| 8 | WEAR RING IMP SUCT SIDE |
| 9 | WEAR RING IMP BAL SIDE |
| 10 | SUCTION BELL |
| 11 | BEARING SECTION |
| 12 | THRUST RING |
| 13 | KEY SQUARE |
| 14 | HEX HEAD CAPSCREW |
| 15 | SOCKET HEAD CAPSCREW |

*FIG. 1B*

| | |
|---|---|
| 1a | CAPSCREW–MOTOR/SUPPORT |
| 1b | SOC. HD. CAPSCREW |
| 1c | HEX NUT |
| 1d | MOTOR SUPPORT |
| 1e | SOC. HD. CAPSCREW |
| 1f | HEX NUT |
| 1g | COUPLING GUARD |
| 1h | STUD & NUT SEAL/HOUSING |
| 1i | CAPSCREW–SUPPORT/HEAD |
| 1j | PIPE PLUG (SUPPORT DRAIN) |
| 1k | O–RING/GASKET–HOUSING/HEAD |
| 1l | BEARING–SEAL HOUSING |
| 1m | BY PASS LINE ASSEMBLY (TUBE & FITTINGS OR PIPE & FLANGES) |
| 1n | MOUNTING HOLES |
| 1o | BY PASS RETURN TO SUMP |
| 1p | SOC. HD. CAPSCREW |
| 1q | THRUST RING |
| 1r | WEAR RING–BOWL (OPTIONAL) |
| 1s | WEAR RING–IMPELLER (OPTIONAL) |
| 1t | KEY–IMPELLER |
| 1u | IMPELLER |
| 1v | SAND COLLAR (OPTIONAL |
| 1w | BEARING–SUCTION |
| 1x | PIPE PLUG (OPTIONAL) |
| 1y | VERTICAL SOLID SHAFT MOTOR |
| 1z | MOTOR KEY (SUPPLIED BY MOTOR VENDOR) |
| 2a | HUB–MOTOR |
| 2b | RING–RETAINING |
| 2c | SPACER |
| 2d | PLATE–ADJUSTING |
| 2e | HUB–PUMP |
| 2f | PUMP KEY |
| 2g | MECHANICAL SEAL |

| | |
|---|---|
| 2h | O–RING/GASKET–SEAL/HOUSING |
| 2i | STUD & NUT–HOUSING/HEAD |
| 2j | HOUSING–SEAL |
| 2k | HEAD |
| 2l | HEADSHAFT |
| 2m | HEX NUT–COL/HEAD |
| 2n | STUD–COL/HEAD |
| 2o | COLUMN–TOP (COLUMN BEARING IS OPTIONAL) |
| 2p | CAPSCREW–COL/COL |
| 2q | HEX NUT–COL/COL |
| 2r | COLUMN–IMTERMEDIATE |
| 2s | LINESHAFT |
| 2t | O–RING–COL/COL/HEAD (OPTIONAL) |
| 2u | BEARING–LINESHAFT |
| 2v | COLUMN–BOTTOM |
| 2w | THREADED COUPLING–LINESHAFT (OR KEYED COUPLING) |
| 2x | PUMPSHAFT |
| 2y | HEX NUT–COL/BOWL |
| 2z | CAPSCREW–COL/BOWL |
| 3a | BEARING–BOWL |
| 3b | BOWL–TOP |
| 3c | CAPSCREW–BOWL/BOWL |
| 3d | BOWL–INTERMEDIATE |
| 3e | O–RING–BELL/BOWL/BOWL (OPTIONAL) |
| 3f | CAPSCREW–BOWL/BELL |
| 3g | CAPSCREW–STRAINER |
| 3h | SUCTION BELL |
| 3i | STRAINER–BASKET TYPE (OPTIONAL) |

*FIG. 1D*: (Prior Art) Index of Components of Pump Shown in FIG. 1A

MULTI-STAGE PUMP WITH ENHANCED THRUST BALANCING FEATURES

CROSS REFERENCE TO RELATED APPLICATIONS

This application claims benefit to patent application Ser. No. 62/504,166, filed 10 May 2017, which is hereby incorporated by reference in its entirety.

BACKGROUND OF THE INVENTION

1. Field of the Invention

The present invention relates to a pump; more particularly to a multi-stage pump having multi-stages with impellers experiencing axial thrust loads.

2. Brief Description of Related Art

Single-suction type impellers in pumps produce axial thrust loads on the pump's rotor which must be absorbed by thrust bearings. Axial thrust loads are the product of pressure difference across the impeller (from hub-side to eye-side) times the area to which that differential pressure is exposed. Therefore, axial thrust loads are in the direction toward the eye-side of the impeller. Larger pumps with larger exposed areas produce higher axial thrust loads and higher head pumps with higher differential pressures across impellers produce higher thrust loads.

For pumps with multiple stages (i.e., two or more impeller-casing sets in series), axial thrust loads are a multiple of the number of stages. Frequently, the total thrust loads on the pump's rotors exceed the load ratings of available thrust bearings.

Currently, axial thrust loads are partly reduced by applying an existing thrust balancing technology. The designs of this existing thrust balancing technology utilize drilled holes through impellers (see FIG. 1A). The drilled holes leak liquid from the hub-side of the impeller to the eye-side of the impeller of each stage, which reduces the pressure differential across each impeller and thereby reduces total axial thrust loads on the pump rotor. However, the thrust reductions of this existing thrust balancing technology are limited to the pressure differential potential of just one pump stage. The thrust reduction of this existing thrust balancing technology is further compromised by high hydraulic friction losses as leakage passes through drilled holes moving at high speeds on the rotating impellers. Therefore, the realized thrust reductions of the existing thrust balancing technology are limited to about 60% of thrust loads without any thrust balance technology. As a result, the axial thrust loads applied to the rotors of large, high-head, multi-stage pumps can still exceed the load ratings of available thrust bearings.

There is a need in the industry for a better way to reduce axial thrust loads on rotors in multi-stage pumps.

SUMMARY OF THE INVENTION

The present invention provides a new and unique thrust balancing technology which reduces the axial thrust loads more effectively on rotors of multi-stage pumps (e.g., see FIG. 2). This new technology has greater thrust reduction capability than the existing thrust balancing technology because it increases the potential pressure reductions across all the impellers after the first-stage impeller. Pressure reductions are further enhanced by leaking liquid through large openings in the pump casings rather than through drilled holes in rotating impellers, which reduces hydraulic friction losses along the leakage passage. This enable new innovative pump designs which have increased realized pressure reductions across impellers; pressure reductions increased by multiple stages of the head rather than to just a percentage of one stage of the head. As a result, axial thrust loads produced by impellers after the first-stage impeller can be minimized, and currently available thrust bearings can be selected for large, high-head, multi-stage pumps. With the present invention, orifices/openings in the casing openings are used to tune the pressure balances across the impellers in each stage, which produce optimum axial thrust loads on the pump rotor (e.g., see FIGS. 2 and 3A thru 3C).

Examples of First and Second Stage Pump Combination Embodiments

According to some embodiments, the present invention may include, or take the form of, a new and unique first stage and second stage pump combination featuring:

- a first stage and a second stage, each stage having an impeller arranged on a rotor of a pump, each impeller having a hub-side and an eye-side, and each impeller configured to pump a liquid through the pump that applies an axial thrust load caused by a pressure difference in an axial direction from the hub-side to the eye-side of each impeller; and
- a first and second stage pump casing configured to form a casing enclosure to contain components of the first stage and the second stage, including each impeller, and also configured with one or more first and second stage pump casing openings formed therein and passing thru the first and second stage pump casing to leak at least some liquid being pumped to the outside of the casing enclosure to reduce substantially the axial thrust load caused by the pressure difference in the axial direction from the hub-side to the eye-side of each impeller.

According to some embodiments of the present invention, the first stage and second stage pump combination may include one or more of the features, as follows:

The first and second stage pump casing may include a first stage casing wall enclosing the first stage and a second stage casing wall enclosing the second stage; and the one or more first and second stage pump casing openings may include one or more first stage openings configured or formed in the first stage casing wall; and one or more second stage openings configured or formed in the second stage casing wall.

The one or more first and second stage pump casing openings may be configured as elongated pump casing openings extending along a longitudinal axis of the first and second stage pump casing.

The elongated pump casing openings may be configured as elongated curved pump casing openings.

Each impeller may include vanes configured or formed with one or more vane openings passing thru the vanes.

The one or more vane openings may be configured or formed as coned vane openings.

The one or more first and second stage pump casing openings may be dimensioned to tune pressure balances across respective impellers in the first stage and the second stage.

The first stage and second stage pump combination may form part of a multi-stage pump having one or more thrust bearings, the rotor being configured to rotate on the one or more thrust bearings and respond to the axial thrust load caused by the pressure difference in the axial direction from the hub-side to the eye-side of each impeller.

Examples of Multi-Stage Pump Embodiments

According to some embodiments, the present invention may also include, or take the form of, a new and unique a multi-stage pump featuring:

- a first stage and a second stage, each stage having an impeller arranged on a rotor of the pump, each impeller having a hub-side and an eye-side, and each impeller configured to pump a liquid through the pump that applies an axial thrust load caused by a pressure difference in an axial direction from the hub-side to the eye-side of each impeller; and
- a first and second stage pump casing, each casing configured to form a casing enclosure to contain components of the first stage and the second stage, including each impeller, and also configured with one or more pump casing openings formed therein and passing thru the pump casing to leak at least some liquid being pumped to the outside of the casing enclosure to reduce substantially the axial thrust load caused by the pressure difference in the axial direction from the hub-side to the eye-side of each impeller.

According to some embodiments of the present invention, the multi-stage pump may include one or more of the features, as follows:

The pump casing may include a first stage casing wall enclosing the first stage and a second stage casing wall enclosing the second stage; and the one or more pump casing openings include one or more first stage openings configured or formed in the first stage casing wall; and one or more second stage openings configured or formed in the second stage casing wall.

The one or more pump casing openings may be configured as elongated pump casing openings extending along a longitudinal axis of the first and second stage pump casing.

The elongated pump casing openings may be configured as elongated curved pump casing openings.

Each impeller may include vanes configured or formed with one or more vane openings passing thru the vanes.

The one or more vane openings may be configured or formed as coned vane openings.

The one or more pump casing openings may be dimensioned to tune pressure balances across respective impellers in the first stage and the second stage.

The multi-stage pump may also include one or more thrust bearings; and the rotor configured to rotate on the one or more thrust bearings and respond to the axial thrust load caused by the pressure difference in the axial direction from the hub-side to the eye-side of each impeller.

The present invention provides a better way to reduce axial thrust loads on rotors in multi-stage pumps.

BRIEF DESCRIPTION OF THE DRAWING

The drawing includes FIGS. 1-3C, which are not necessarily drawn to scale:

FIG. 1B shows a parts list for the first and second stages shown in FIG. 1A.

FIG. 1D shows a parts list of at least some basic parts or components of the pump shown in FIG. 1C.

DETAILED DESCRIPTION OF THE INVENTION

The Basic Invention

FIGS. 2 and 3A thru 3C show a new and unique first stage and second stage pump combination generally indicated as 100. The first stage and second stage pump combination includes a first stage generally indicated as 102, a second stage generally indicated as 104, and a first and second stage pump casing 112, 114.

Figure 1A:
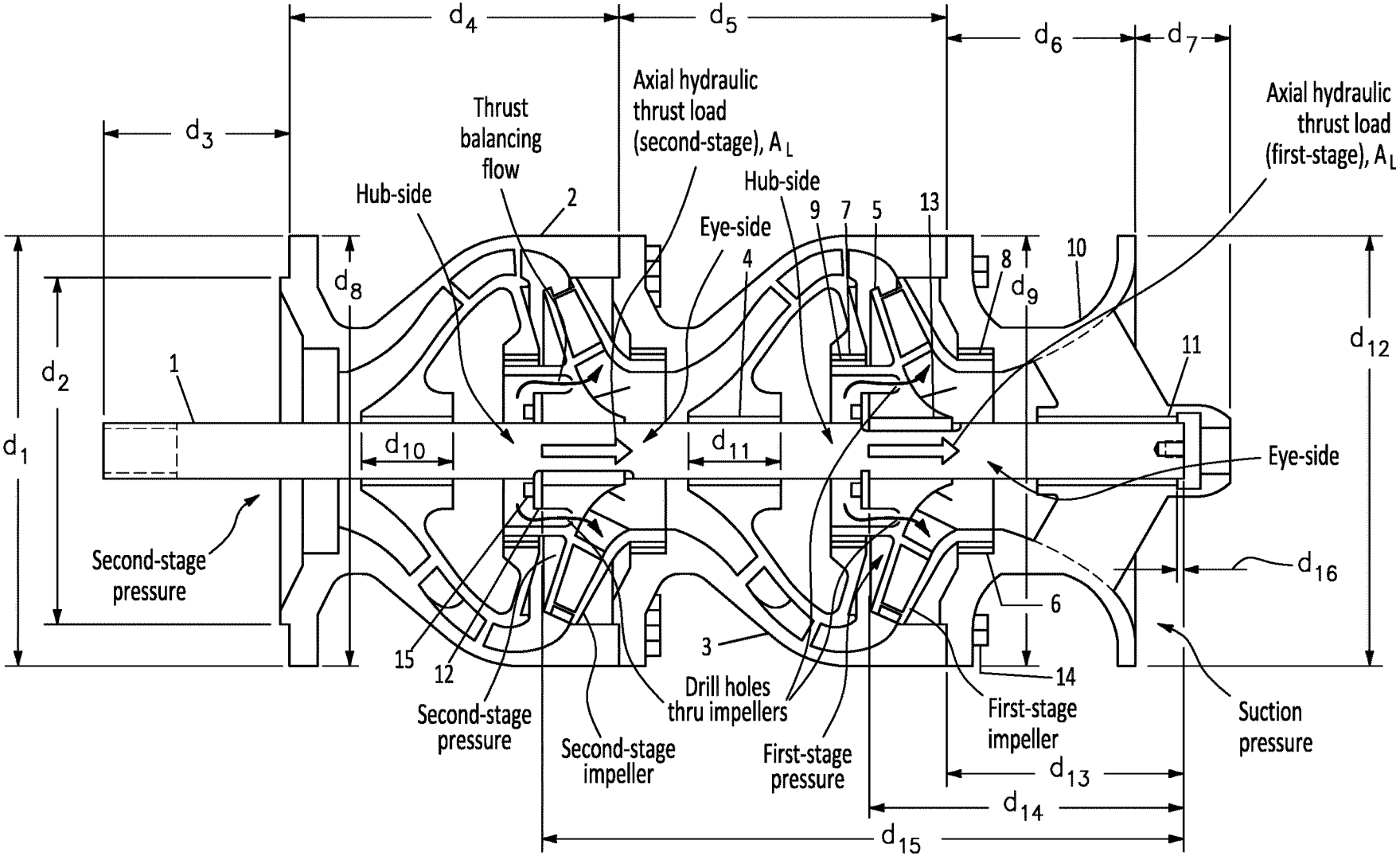
FIG. 1A shows a cross-sectional view of part of first and second stages of a multi-stage pump that is known in the art.
Figure 1C:
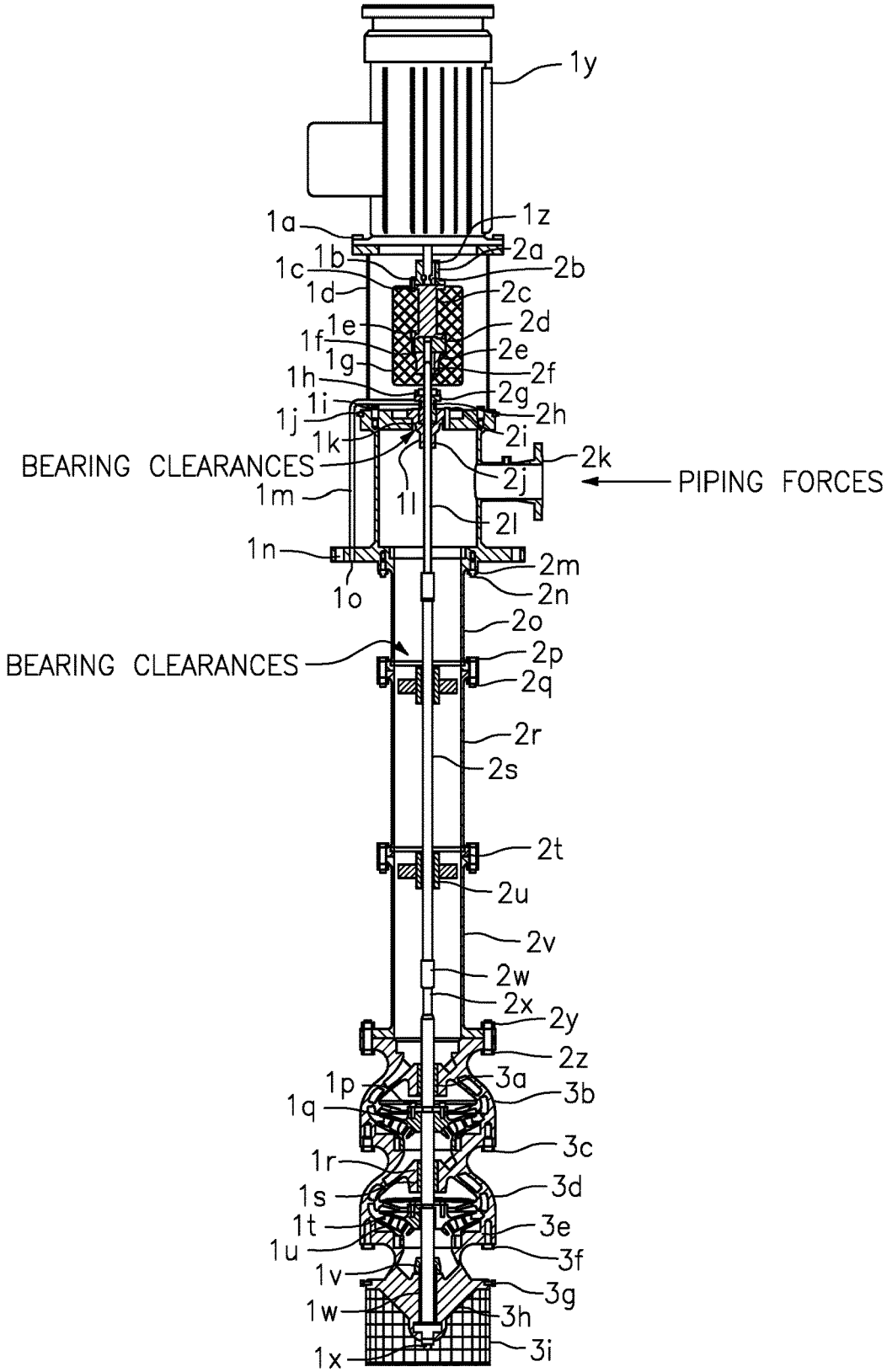
FIG. 1C (Prior Art)
FIG. 1C shows a cross-sectional view of a pump that is also known in the art, and disclosed in U.S. application Ser. No. 14/163,235, as set forth below.

Each stage 102, 104 includes an impeller 102*a*, 104*a* arranged on a rotor R of a pump, e.g. like a multistage pump (FIG. 1C). Each impeller 102*a*, 104*a* has a hub-side generally indicated as $H_1$, $H_2$ and an eye-side generally indicated as $E_1$, $E_2$. Each impeller 102*a*, 104*a* may also be configured to pump a liquid through the pump, e.g., from the suction bell, through the first stage 102 and the second stage 104, and up through the column C, that applies an axial thrust load caused by a pressure difference in an axial direction from the hub-side $H_1$, $H_2$ to the eye-side $E_1$, $E_2$ of each impeller 102*a*, 104*a*.

Each casing 112, 114 may be configured to form a casing enclosure to contain components of the first stage 102 and the second stage 104, e.g., including each impeller 102*a*, 104*a*. As one skilled in the art would appreciate, the components may include various other parts of corresponding upper and lower thrust bearings arranged between the impellers 102*a*, 104*a* and the rotor R, etc. The first and second stage pump casing 112, 114 may also be configured with one or more first and second stage pump casing openings 112*a*, 112*b*, 112*c*; 114*a*, 114*b*, 114*c* formed therein and passing thru the first and second stage pump casing 112, 114 to leak at least some liquid L being pumped to the outside of the casing enclosure to reduce substantially the axial thrust load caused by the pressure difference in the axial direction from the hub-side $H_1$, $H_2$ to the eye-side $E_1$, $E_2$ of each impeller 102*a*, 104*a*.

Figure 2:
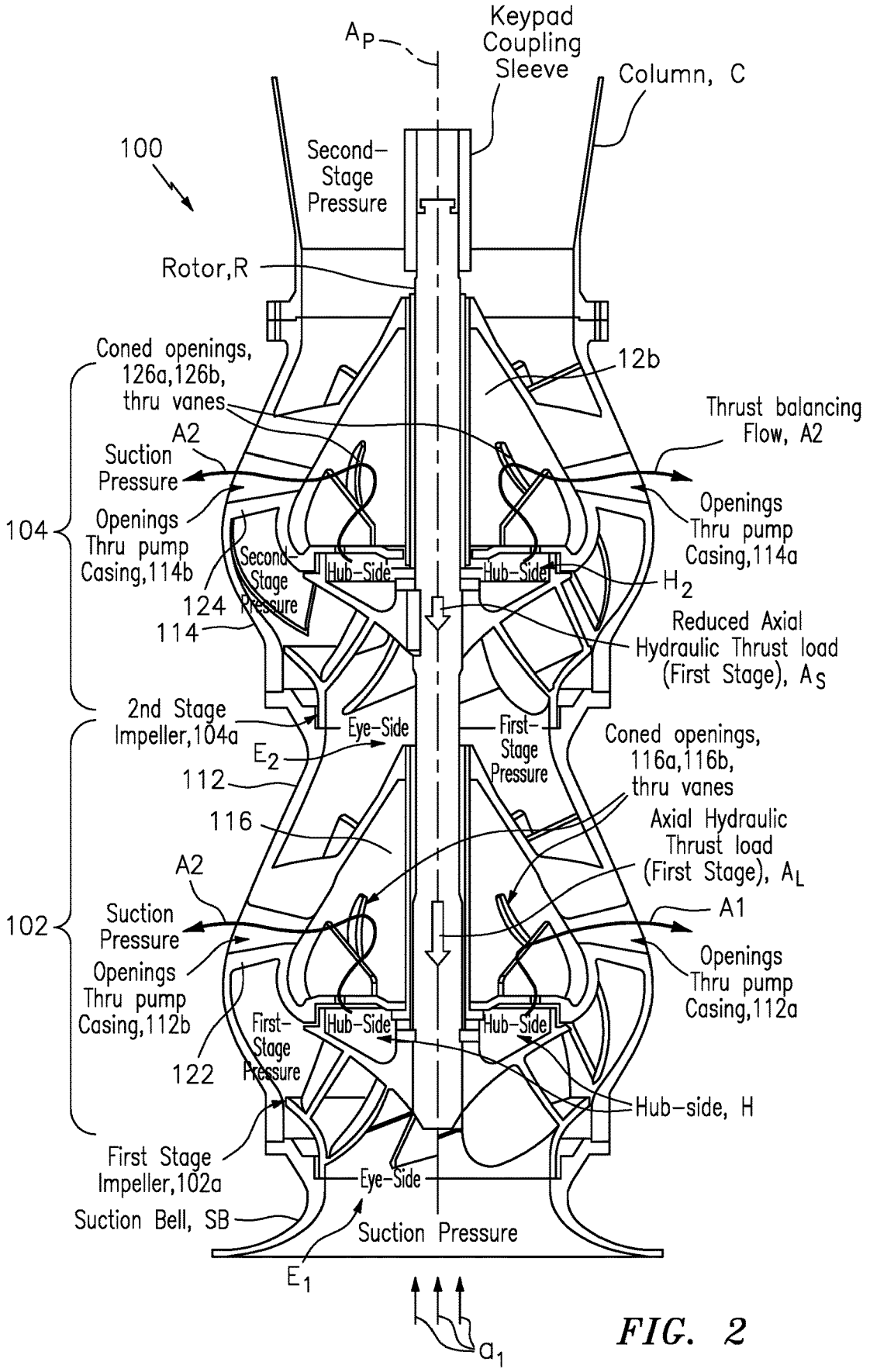
FIG. 2 is a cross-sectional view of part of first and second stages of a multi-stage pump, according to some embodiments of the present invention.

FIG. 2 shows a long arrow $A_L$ for the axial hydraulic thrust load of the first stage 102, and also shows a shorter arrow $A_S$ for the reduced axial hydraulic thrust load of the second stage 104. (Compare that shown in FIG. 1B having two long arrows $A_L$, e.g., because there is no reduced axial hydraulic thrust load in the second stage.) Moreover, FIG. 2 also shows the at least some liquid being pumped to the outside of the casing enclosure as a thrust balancing flow and designated by arrows A1 and A2. Moreover still, FIG. 2 also indicates where the "first-stage pressure" and the "second stage pressure" builds up in relation to the first stage 102 and the second stage 104, as well as the suction pressure (see arrow $a_1$) caused in the area of the suction bell, SB, by the rotation of the multi-stage impellers 102*a*, 104*a* in operation.

The first stage and second stage pump combination 100 may include one or more of the features, as follows:

The First and Second Stage Pump Casing Openings

The first and second stage pump casing 112, 114 may include a first stage casing wall 122 enclosing the first stage 102 and a second stage casing wall 124 enclosing the second stage 104. The one or more first and second stage pump casing openings 112*a*, 112*b*, 112*c*; 114*a*, 114*b*, 114*c* may include one or more first stage openings 112*a*, 112*b*, 112*c* configured or formed in the first stage casing wall 122; and one or more second stage openings 112*a*, 112*b*, 112*c*; 114*a*, 114*b*, 114*c* configured or formed in the second stage casing wall 114*a*, 114*b*, 114*c*. (The FIGS. 2 and 3A thru 3C show some but not necessarily all of the first and second stage pump casing opening, which are configured symmetrically, and equi-distantly spaced, around first and second stage pump casing 112, 114 in the embodiments shown.)

By way of example, the one or more first and second stage pump casing openings like elements 112*a*, 112*b*, 112*c*; 114*a*, 114*b*, 114*c* may be configured as elongated pump casing openings extending along a longitudinal axis $A_P$ (see FIG. 2) of the pump and the first and second stage pump casing 112, 114.

Figure 3A:
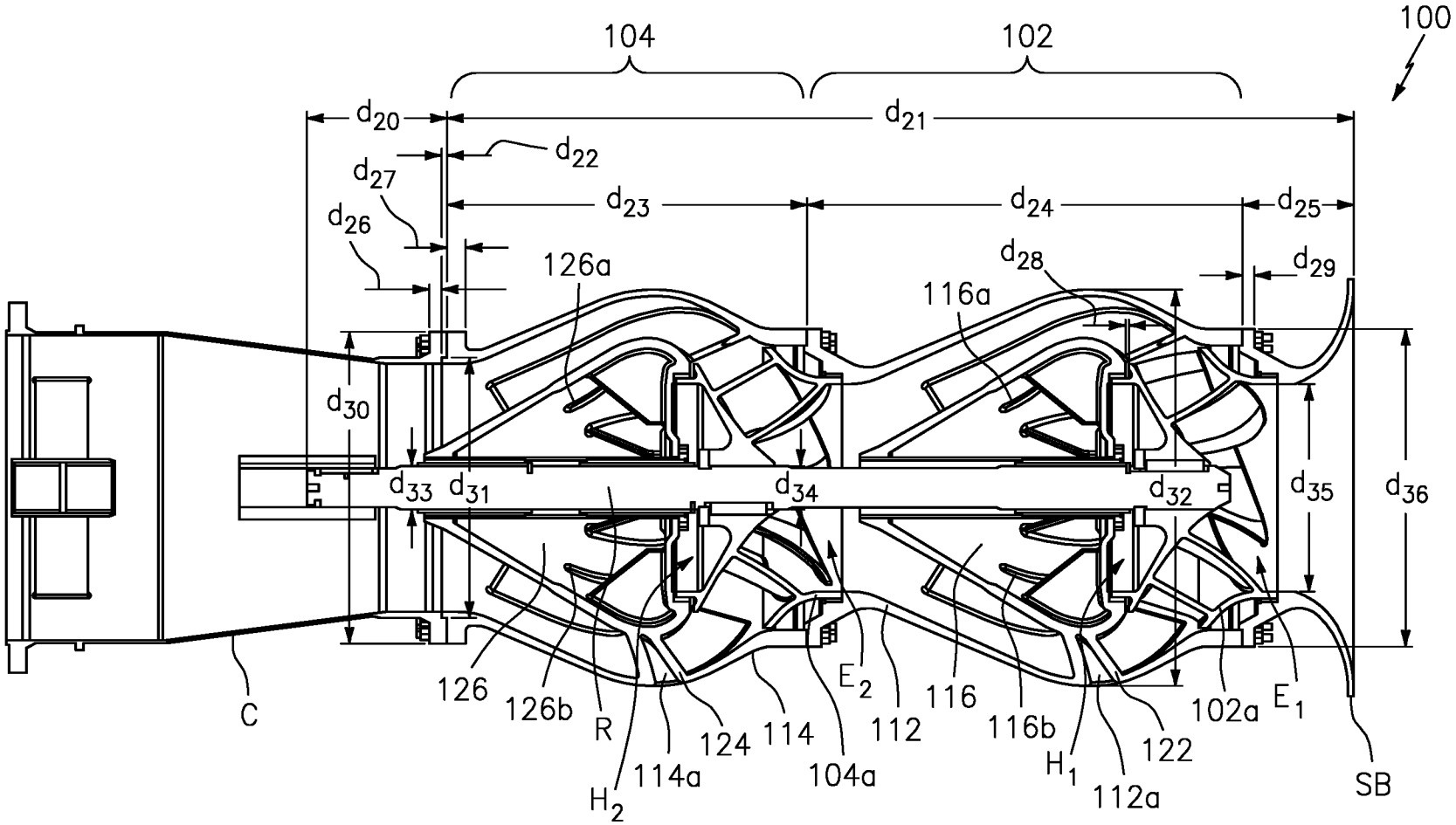
FIG. 3A is a cross-sectional view of part of first and second stages of a multi-stage pump, according to some embodiments of the present invention.
Figure 3B:
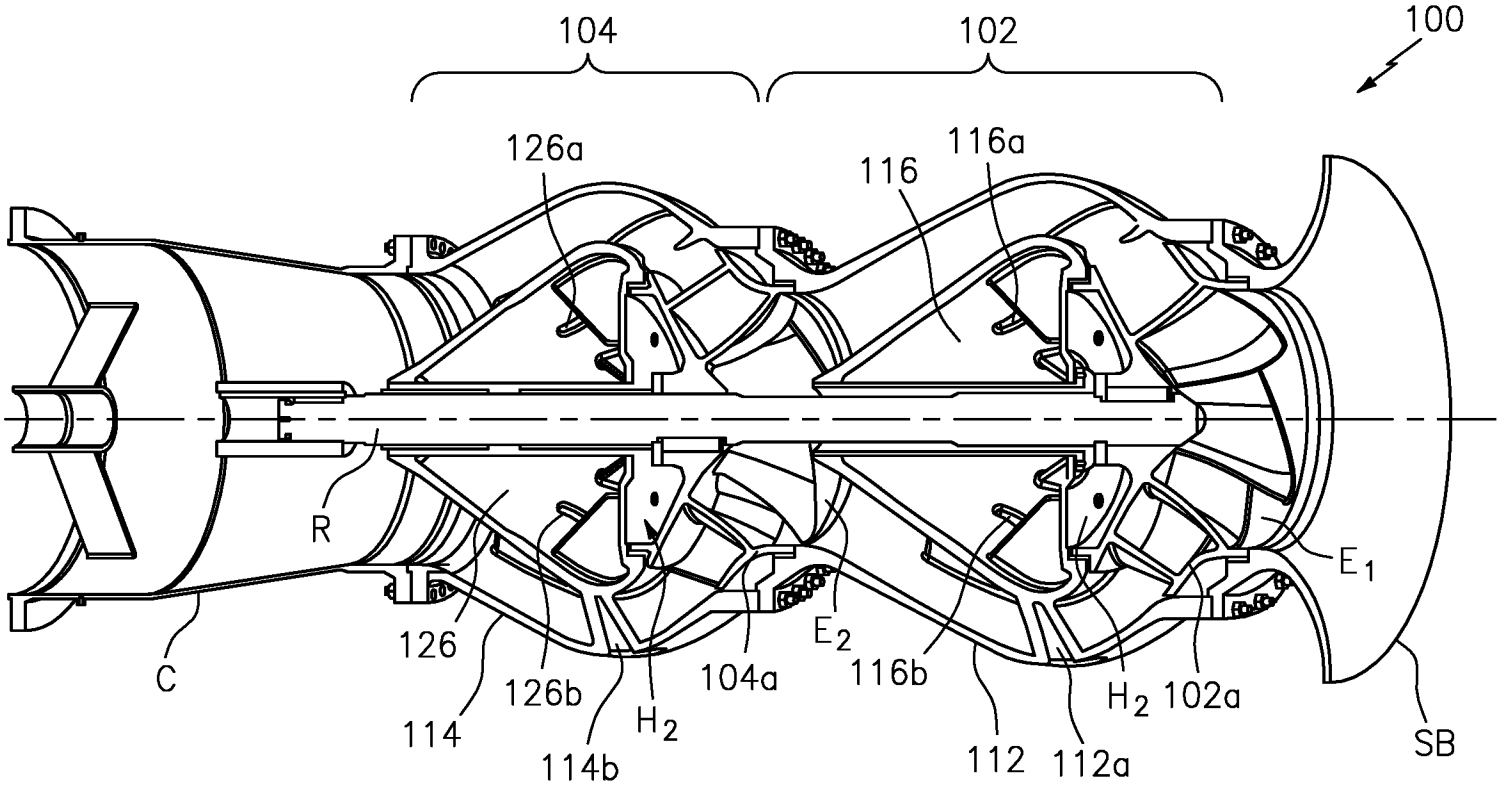
FIG. 3B is a perspective, cross-sectional view of part of first and second stages of a multi-stage pump, according to some embodiments of the present invention.
Figure 3C:
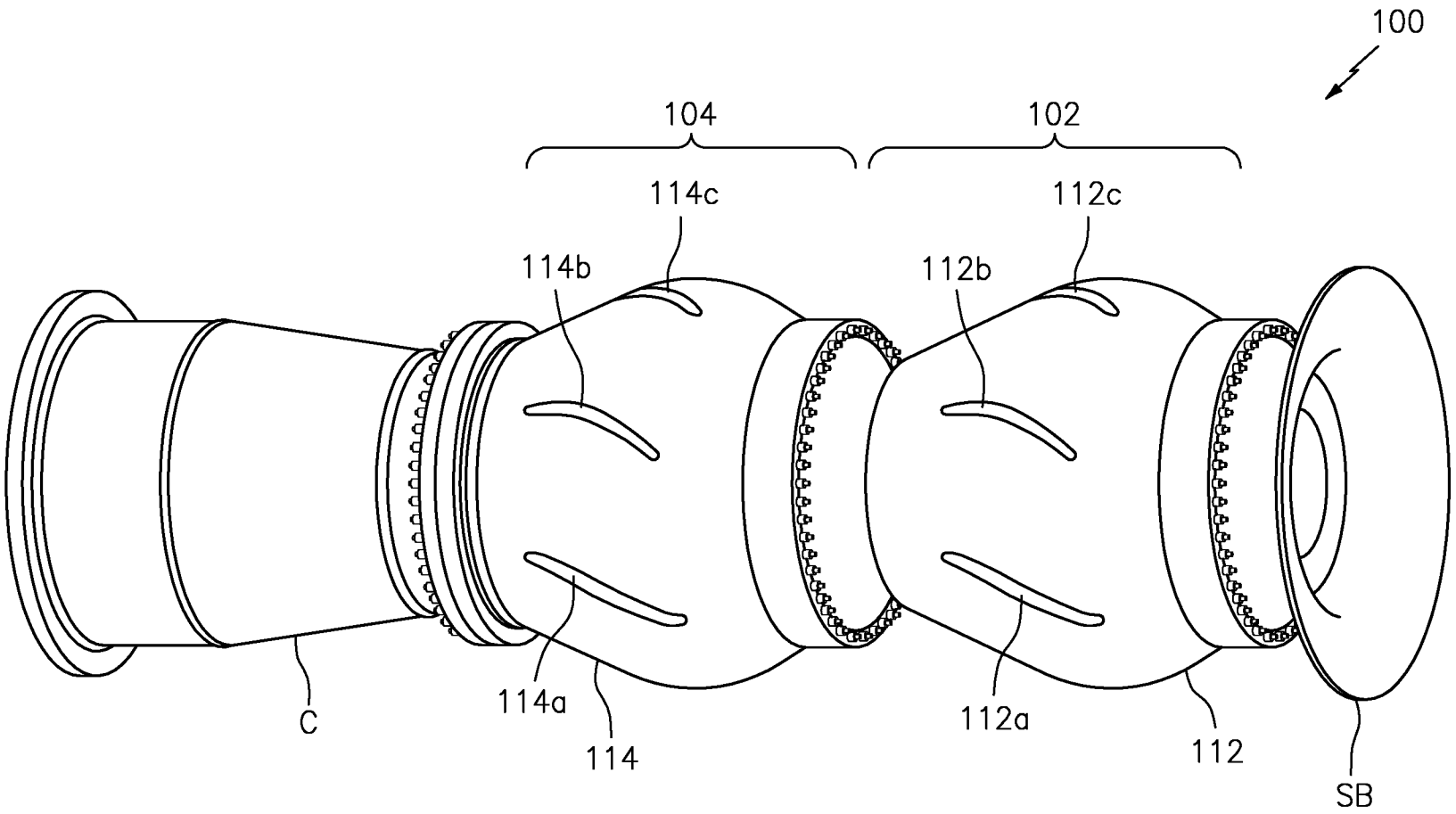
FIG. 3C is a side perspective view of part of first and second stages of a multi-stage pump, according to some embodiments of the present invention.

By way of a further example, the elongated pump casing openings like elements 112*a*, 112*b*, 112*c*; 114*a*, 114*b*, 114*c* may be configured as elongated curved pump casing openings, e.g., as shown in FIG. 3C, although the scope of the invention is not intended to be limited to any particular type or kind of geometric configuration. For example, embodiments are envisioned, and the scope of the invention is intended to include forming the pump casing openings like elements 112*a*, 112*b*, 112*c*; 114*a*, 114*b*, 114*c* with other types or kinds of geometric configurations either now known or later developed in the future.

Further, the scope of the invention is not intended to be limited to any particular number of pump casing openings, e.g., in the first stage, the second stage, or the combination thereof. For example, embodiments are envisioned, and the scope of the invention is intended to include, forming the pump casing openings like elements 112*a*, 112*b*, 112*c*; 114*a*, 114*b*, 114*c* with a different number of pump casing openings than that shown in FIGS. 2 and 3A thru 3C, or forming the pump casing openings like elements 112*a*, 112*b*, 112*c*; 114*a*, 114*b*, 114*c* with a different number of openings in the first stage than in the second stage, such as with fewer openings in one stage (including no openings at all), and more openings in the other stage, etc.

The Impeller Vane Openings

Each impeller 102*a*, 104*a* may include vanes 116, 126 configured or formed with one or more vane openings like elements 116*a*, 116*b*; 126*a*, 126*b* passing thru the vanes 116, 126. (The FIGS. 2 and 3A thru 3B show some but not necessarily all of the vane opening.) The one or more vane openings like elements 116*a*, 116*b*; 126*a*, 126*b* may be configured or formed as coned vane openings, although the scope of the invention is not intended to be limited to any particular type or kind of geometric configuration. For example, embodiments are envisioned, and the scope of the invention is intended to include, forming the one or more vane openings like elements 116*a*, 116*b*; 126*a*, 126*b* with other types or kinds of geometric configurations either now known or later developed in the future. Further, the scope of the invention is not intended to be limited to any particular number of vane openings, e.g., in the first stage vane, the second stage vane, or the combination thereof. For example, embodiments are envisioned, and the scope of the invention is intended to include, forming the one or more vane openings like elements 116*a*, 116*b*; 126*a*, 126*b* with a different number of vane openings than that shown in FIGS. 2 and 3A thru 3C, or forming the one or more vane openings like elements 116*a*, 116*b*; 126*a*, 126*b* with a different number of vane openings in the first stage vane than in the second stage vane, such as with fewer vane openings in the impeller vane in one stage, and more vane opening in the other impeller vane in the other stage, etc. . . .

The Pressure Balance Tuning

Furthermore, the one or more first and second stage pump casing openings like elements 112*a*, 112*b*, 112*c*; 114*a*, 114*b*, 114*c* may be dimensioned to tune pressure balances across respective impellers 102*a*, 104*a* in the first stage 102 and the second stage 104. One skilled in the art after reading the instant patent application, and without undue experimentation, would appreciate and understand how to dimension the one or more first and second stage pump casing openings like elements 112*a*, 112*b*, 112*c*; 114*a*, 114*b*, 114*c* to tune pressure balances across respective impellers 102*a*, 104*a* in the first stage 102 and the second stage 104. By way of example, the pressure balance tuning may include dimensioning the one or more first and second stage pump casing openings like elements 112*a*, 112*b*, 112*c*; 114*a*, 114*b*, 114*c* to be larger or smaller, or longer or shorter, in the first stage 102, the second stage 104, or both stages; adapting the number of the one or more first and second stage pump casing openings like elements 112*a*, 112*b*, 112*c*; 114*a*, 114*b*, 114*c*, e.g., in the first stage 102, the second stage 104, or both stages; adapting the geometric configuration of the one or more first and second stage pump casing openings like elements 112*a*, 112*b*, 112*c*; 114*a*, 114*b*, 114*c*, e.g., in the first stage 102, the second stage 104, or both stages, e.g., including by using different geometric configurations in different stages; etc.

Multi-Stage Pump

By way of example, the present invention is shown and described in relation to a two-stage pump. However, the invention is not intended to be limited to a multi-stage pump having any particular number of stages. The scope of the invention is intended to include, and embodiments are envisioned in which, the present invention being implemented in a multi-stage pump having more than two stages, e.g., including three stages, four stage, five stages, etc.

The Dimensions

FIGS. 1A and 3A are respectively taken from assembly drawings that included numerous dimensional relationships between different parts/components of the first and second stages shown therein, e.g., which are indicated by references labels $d_1$, $d_2$, $d_3$, . . . , $d_{16}$ in FIG. 1A; as well as $d_{20}$, $d_{21}$, $d_{22}$, . . . , $d_{36}$ in FIG. 3A. The scope of the invention is not intended to be limited to any particular dimension of, or any particular dimensional relationship between, any part(s) or component(s) forming part of the first and second stages of the multi-stage pump.

Moreover, as one skilled in the art would appreciate, any such first and second stage of any such multi-stage pump may include many different dimensions of, or particular dimensional relationships between, any part(s) or component(s) forming part of the first and second stages of the multi-stage pump with the scope and spirit of the present invention.

Related Pump Technology

This application relates to a family of pump technologies developed and commonly owned by the assignee of the present application, e.g., including the following:

U.S. Pat. No. 8,226,352, issued 24 Jul. 1012 (07GI008US/911-2.34-2), entitled "O" head design;"

U.S. Pat. No. 9,377,027, issued 28 Jun. 1016 (F-GI-1102US/911-2.43-1), entitled "Vertical double-suction pump having beneficial axial thrust;"

U.S. application Ser. No. 14/163,235, filed 24 Jan. 2014 (F-GI-1202US/911-2.59-1), entitled "Vertical pump having discharge head with flexible element;" and U.S. application Ser. No. 14/511,328, filed 10 Oct. 2014 (F-GI-1403US/911-2.65-1), entitled "Vertical pump having motor support with truss elements;"

which are all incorporated by reference in their entirety.

THE SCOPE OF THE INVENTION

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

What is claimed is:

1. A first stage and second stage pump combination, comprising:

a first stage and a second stage, each stage having an impeller arranged on a rotor of a pump, each impeller having a hub-side and an eye-side, and each impeller configured to pump a liquid through the pump that applies an axial thrust load caused by a pressure difference in an axial direction from the hub-side to the eye-side of each impeller; and a first and second stage pump casing, each casing configured to form a casing enclosure to contain components of the first stage and the second stage, including each impeller, and also configured with one or more first and second stage pump casing openings formed therein and passing thru the first and second stage pump casing to leak at least some liquid being pumped to the outside of the casing enclosure to reduce substantially the axial thrust load caused by the pressure difference in the axial direction from the hub-side to the eye-side of each impeller, wherein the one or more first and second stage pump casing openings are configured as elongated pump casing openings extending along a longitudinal axis of the first and second stage pump casing.

2. The first stage and second stage pump combination according to claim 1, wherein the first and second stage pump casing comprises a first stage casing wall enclosing the first stage and a second stage casing wall enclosing the second stage; and the one or more first and second stage pump casing openings include one or more first stage openings configured or formed in the first stage casing wall; and one or more second stage openings configured or formed in the second stage casing wall.

3. The first stage and second stage pump combination according to claim 1, wherein the elongated pump casing openings are configured as elongated curved pump casing openings.

4. The first stage and second stage pump combination according to claim 1, wherein each impeller includes vanes configured or formed with one or more vane openings passing thru the vanes.

5. The first stage and second stage pump combination according to claim 4, wherein the one or more vane openings are configured or formed as coned vane openings.

6. The first stage and second stage pump combination according to claim 1, wherein the one or more first and second stage pump casing openings are dimensioned to tune pressure balances across respective impellers in the first stage and the second stage.

7. The first stage and second stage pump combination according to claim 1, wherein the first stage and second stage pump combination forms part of a multi-stage pump having one or more thrust bearings, the rotor being configured to rotate on the one or more thrust bearings and respond to the axial thrust load caused by the pressure difference in the axial direction from the hub-side to the eye-side of each impeller.

8. A multi-stage pump comprising:

a first stage and a second stage, each stage having an impeller arranged on a rotor of the pump, each impeller having a hub-side and an eye-side, and each impeller configured to pump a liquid through the pump that applies an axial thrust load caused by a pressure difference in an axial direction from the hub-side to the eye-side of each impeller; and a first and second stage pump casing, each casing configured to form a casing enclosure to contain components of the first stage and the second stage, including each impeller, and also configured with one or more pump casing openings formed therein and passing thru the pump casing to leak at least some liquid being pumped to the outside of the casing enclosure to reduce substantially the axial thrust load caused by the pressure difference in the axial direction from the hub-side to the eye-side of each impeller, wherein the one or more pump casing openings are configured as elongated pump casing openings extending along a longitudinal axis of the first and second stage pump casing.

9. The multi-stage pump according to claim 8, wherein:

the pump casing comprises a first stage casing wall enclosing the first stage and a second stage casing wall enclosing the second stage; and the one or more pump casing openings include one or more first stage openings configured or formed in the first stage casing wall; and one or more second stage openings configured or formed in the second stage casing wall.

10. The multi-stage pump according to claim 8, wherein the elongated pump casing openings are configured as elongated curved pump casing openings.

11. The multi-stage pump according to claim 8, wherein each impeller includes vanes configured or formed with one or more vane openings passing thru the vanes.

12. The multi-stage pump according to claim 11, wherein the one or more vane openings are configured or formed as coned vane openings.

13. The multi-stage pump according to claim 8, wherein the one or more pump casing openings are dimensioned to tune pressure balances across respective impellers in the first stage and the second stage.

14. The multi-stage pump according to claim 8, wherein the multi-stage pump comprises:

one or more thrust bearings; and the rotor configured to rotate on the one or more thrust bearings and respond to the axial thrust load caused by the pressure difference in the axial direction from the hub-side to the eye-side of each impeller.

* * * * *